United States Patent [19]

Bouwkamp

[11] 3,980,234

[45] Sept. 14, 1976

[54] FUEL INJECTION NOZZLE

[75] Inventor: Gerald R. Bouwkamp, West Hartford, Conn.

[73] Assignee: Stanadyne, Inc., Hartford, Conn.

[22] Filed: June 13, 1975

[21] Appl. No.: 586,567

[52] U.S. Cl. ..... 239/533; 239/584

[51] Int. Cl.[2] ..... B05B 1/30

[58] Field of Search ..... 239/583, 584, 533, 95

[56] References Cited

UNITED STATES PATENTS

| | | | |
|---|---|---|---|
| 2,595,639 | 5/1952 | Chmura et al. | 239/533 X |
| 2,602,703 | 7/1952 | Camner | 239/533 |
| 2,865,675 | 12/1958 | Roosa | 239/533 UX |
| 3,115,304 | 12/1963 | Humphries | 239/533 X |
| 3,255,974 | 6/1966 | Roosa | 239/533 |
| 3,409,225 | 11/1968 | Maddalozzo et al. | 239/95 X |
| 3,511,442 | 5/1970 | DeLuca et al. | 239/533 |
| 3,777,986 | 12/1973 | Kinzel et al. | 239/533 |

FOREIGN PATENTS OR APPLICATIONS

| | | | |
|---|---|---|---|
| 119,780 | 3/1945 | Australia | 239/533 |
| 513,710 | 12/1930 | Germany | 239/533 |
| 478,052 | 1/1938 | United Kingdom | 239/533 |
| 455,131 | 10/1936 | United Kingdom | 239/533 |
| 494,951 | 11/1938 | United Kingdom | 239/533 |

*Primary Examiner*—Robert S. Ward, Jr.
*Attorney, Agent, or Firm*—Prutzman, Hayes, Kalb & Chilton

[57] ABSTRACT

There is disclosed a nozzle having a three-part nozzle body comprising a nozzle holder, a valve guide and a nozzle tip which are positioned and axially aligned by a surrounding retaining nut. Communicating passages for the delivery of fuel to the nozzle tip are provided in the walls of the nozzle body and a pair of locating pins span the mating ends of the three parts thereof to maintain them in angular alignment. The locating pins are of different diameters and are placed in the ends of a single stepped bore of the valve guide. A gland nut surrounding the nozzle holder is provided to mount the nozzle in the bore of an engine and a keeper ring around the nozzle holder engages the outer end of the gland nut to apply an axial extracting force when the gland nut is unscrewed.

2 Claims, 1 Drawing Figure

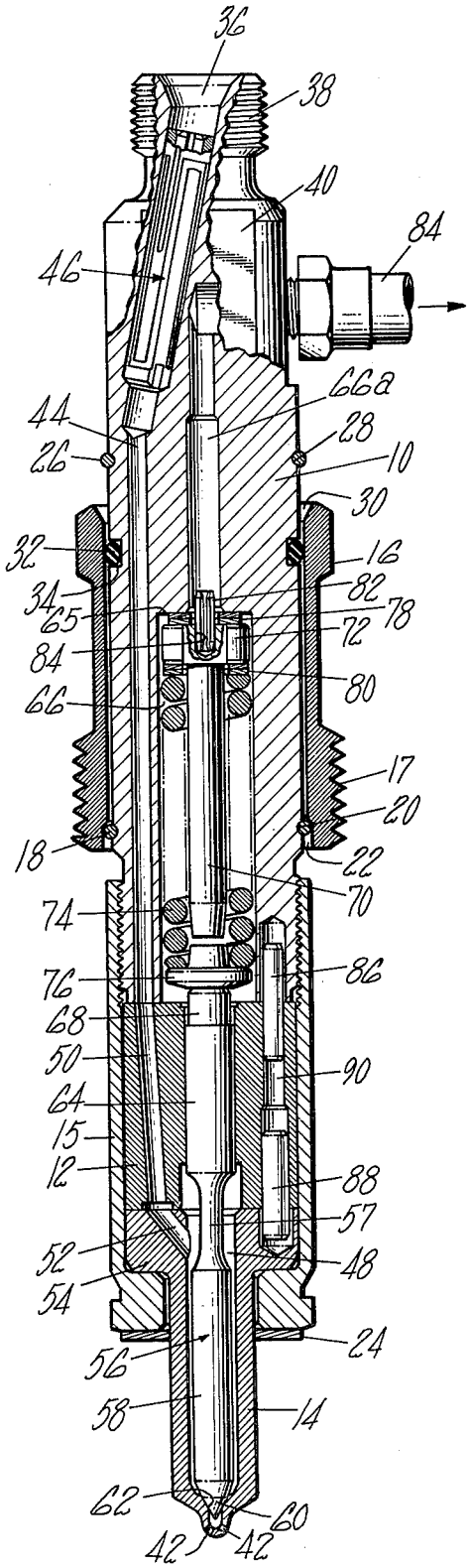
36
38
40
84
46
66a
44
28
26
10
30
32
16
34
82
65
78
72
84
80
66
17
20
18
22
70
74
86
76
68
50
90
64
15
12
88
57
52
48
54
24
56
58
14
62
60
42
42

FUEL INJECTION NOZZLE

This invention relates to fuel injection nozzles for internal combustion engines, and more particularly to such nozzles of the type having an inwardly opening pressure actuated valve adapted to be lifted from its seat by the pressure of measured charges of fuel delivered to the nozzle.

In the operation of fuel injection nozzles of the type involved, one of the difficulties heretofore experienced has resulted from the fact that a close sliding fit is required between the valve and the valve guide to minimize leakage from the valve chamber and prevent excessive loss of injection pressure. This close sliding fit, however, renders the mating surfaces of the valve plunger and the nozzle guide susceptible to sticking or seizure during operation particularly where there is any misalignment of the parts during assembly or warping of the nozzle under the high temperature conditions of operation. Such sticking has a high undesirable effect on such factors as injection timing, fuel spray pattern, cylinder to cylinder variation in fuel-air ratio and the like and hence can seriously effect engine operation.

One object of the invention is to provide an improved nozzle of the inwardly opening pressure actuated type in which the valve is mounted in a novel manner permitting close tolerances between the valve and the valve guide while reducing the possibility of seizure or sticking of the valve.

Another object is to provide such a nozzle wherein the nozzle body includes a valve guide and a nozzle tip which are separate parts held in accurate alignment by a unique coupling arrangement.

Another object of the invention is to provide a nozzle having a replaceable nozzle tip and valve which is simplified in the construction and reduced in cost, which may be easily assembled and in which accurate alignment of the nozzle guide and the nozzle tip is automatically achieved during assembly.

Other objects will be in part obvious and in part pointed out more in detail hereinafter.

A better understanding of the invention will be obtained from the following detailed description and the accompanying drawing of an illustrative application of the invention.

In the drawing, the single FIGURE is a longitudinal cross-sectional view of a nozzle constructed in accordance with this invention.

Referring to the drawing, the exemplary nozzle shown therein and embodying the present invention includes a three-part body comprising a nozzle holder 10, a valve guide 12 and a nozzle tip 14. A retaining nut 15 couples the valve guide 12 and the nozzle tip 14 to the nozzle holder 10 as hereinafter more fully described. Surrounding the nozzle holder 10 is a gland nut 16 for mounting the valve assembly in the nozzle bore of an associated engine. The gland nut 16 is provided with external threads 17 which are engageable with mating threads in the nozzle bore of the associated engine.

A keeper ring 18, mounted in an annular groove 20 of the nozzle holder 10, engages an annular wall within a counterbore 22 at the end of the gland nut to transfer compressive forces between the gland nut 16 and the seal washer 24 which seals the nozzle bore when the nozzle is mounted on the engine. A second keeper ring 26, positioned in another annular groove 28 formed in the nozzle holder 10, engages a tapered annular recess 30 at the opposite end of the gland nut so that the unscrewing of the gland nut 16 applies a tensile force on the nozzle for removal of the nozzle from the engine.

A resilient O-ring 32 positioned in annular groove 34 is provided between the internal periphery of the gland nut 16 and the nozzle holder 10 to provide a seal to prevent the moisture or dirt from causing the seizure of the gland nut to the nozzle holder.

The nozzle is provided with an inlet port 36 to which an inlet line (not shown) may be connected for delivering measured charges of high pressure fuel to the nozzle from an associated pump. As shown, the end of the nozzle is threaded at 38 to threadably engage a mating coupling nut to form a high pressure connection with the inlet line.

Flats 40 are provided at the upper end of the holder 10 to receive a wrench to prevent the rotation of the nozzle when the high pressure line is connected and also to serve as an indicator for the orientation of the spray emanating from the discharge orifices 42 which may be asymetrically located with respect to the axis of the nozzle.

The inlet port 36 communicates with a longitudinal side passage 44 through the wall of the holder past an edge filter 46 which prevents the passage of solid particles which might otherwise plug the discharge orifices 42. The side passage 44 communicates with the valve chamber 48 formed by the bore of the nozzle tip 14 through aligned connecting passages 50, 52 in the valve guide 12 and the flanged base 54 of the nozzle tip 14.

An elongated valve 56 is mounted by the valve guide 12 for reciprocating movement. The stem 58 of the valve extends into the valve chamber 48 of the nozzle tip 12 with the end 60 thereof being conical and adapted to cooperate with the conical seat 62 formed in the nozzle tip 14 to control the discharge of fuel through nozzle orifices 42. The elongated guide portion 64 of the valve and the mating bore of the valve guide 12 are lap finished and dimensioned with respect to each other so as to minimize the leakage therebetween and to provide a long leakage path past the valve guide from the valve chamber 48.

A stepped concentric bore 65 within the nozzle holder 10 comprises a spring chamber 66 in which is positioned a lift stop having a stem 70 and a flanged upper end 72 which serves as a spring seat for the biasing spring 74. The inner diameter of the spring 74 has a close sliding fit with the stem 70 of the lift stop and the opposite end of the biasing spring 74 mounts the lower spring seat 76 which engages the end 68 of the valve to bias the conical tip 60 of the valve into engagement with conical valve seat 62 provided by the nozzle tip 14. By virtue of the cooperation between the biasing spring 74 and the stem 70 of the lift stop, the spring seat is biased laterally toward a position concentric with the stem 70 to prevent engagement of the spring seat and the side walls of the spring chamber 66 without imparting lateral forces on the upper end of the valve which would tend to cause the binding thereof. This arrangement for supporting the lower spring seat is more fully disclosed and claimed in U.S. Pat. No. 3,806,041.

In order to accommodate manufacturing variations and tolerances, the lift stop is adjusted by means of shims 78 positioned between the flanged upper end 72 of the lift stop and a shoulder formed by the step of the bore 65 to adjust the maximum lift of the nozzle valve from the valve seat. Similarly, shims 80 may be provided for adjusting the spring pressure which biases the valve against the valve seat 62 to determine the opening pressure of fuel in the valve chamber 48 acting to move the valve upwardly from its seat. As shown, the shims 78 are apertured and a hollow spring pin 82 having a diameter less than that of stem 70 is mounted in a recess 84 in the upper end of the lift stop to provide an indicator of the correct installation of the two sets of shims in the event of disassembly of the valve in the field.

The hollow spring pin 82 also serves to provide communication between the spring chamber 66 and the leak-off line 84 through passage 66*a* to return any seepage between the valve 56 and the valve guide 12 back to the tank.

Typically, the pressure required for the fuel in the valve chamber 48 to lift the valve from the seat is between 2,000 to 3,000 psi. It will be apparent that the spring force of the biasing spring 74 which will hold the valve 56 against the valve seat 62 below that level will, upon the sudden drop of the pressure in valve chamber 48 at the termination of injection, cause the valve to return to the valve seat with great impact. The pounding resulting from the repetitive opening and closing of the valve, as well as the necessity for guarding against leakage out of the valve chamber past the valve guide 12 during the life of the nozzle, make it essential that the valve, the valve guide 12, and the nozzle tip 14 be formed of heat treated hardend metals to promote long wear and the ability to withstand the pounding without deformation.

Such hardened material is, however, less deformable than a softer material and thus where used to form a metal-to-metal seal is more susceptible to leakage as a result of surface damage to one of the sealing surfaces where one of the members forming the metal-to-metal seal is made of a softer or more deformable material.

A pair of locating spring pins 86, 88 are provided to locate the valve guide at a fixed rotational position with respect to the valve holder and the valve holder at a fixed rotational position with respect to the tip to assure the alignment of the inlet passages 44, 50, 52 for delivering high pressure fuel to the valve chamber 48. The locating pin 86 is smaller than locating pin 88 with both being mounted in the respective ends of stepped bore 90. With this construction, it is possible to remove pin 88 from the valve guide 12 by pushing pin 86 downwardly into engagement with pin 88 and remove pin 88 without any possibility of contact with or damage to the lapped surface of the valve guide 12 which mates with the nozzle tip 14 to form a metal-to-metal seal between these hardened parts.

The exterior surface of the hardened steel valve guide 12 and of nozzle tip 14 are ground to a close tolerance of as little as 0.00025 radial clearance with the interior surface of the retaining nut 15. With this precision fit, the assembly of the retaining nut over the nozzle tip and valve guide automatically and precisely coaxially aligns the valve guide and nozzle tip. When the retaining nut is tightened, it clamps the hardened lapped finish abutting surfaces of the nozzle tip 14 and the valve guide 12 both of which are formed perpendicular to the axes of the valve guide and the nozzle tip respectively, and the valve guide 12 against the nozzle holder 10 to provide metal-to-metal seals. The necked down portion 57 will accommodate any misalignment which may develop due to distortion of the valve during use, or very slight misalignments which might occur in assembly.

Preferably, an anti-seize lubricant containing graphite is coated on the interior wall of the retaining nut 15 to minimize the torsional forces imparted on the locator pins 86, 88 during the assembly and disassembly of the retaining nut.

When the nozzle has been assembled and placed in operation, fuel under pressure is introduced through the inlet 36 and passes relatively freely through the side passages 44, 50, 52 into the valve chamber 48 to apply a pressure tending to lift the valve 56 from its seat. The fuel pressure thus applied to the tapered tip of the valve and the differential area of the guide portion 64 of the valve relative to the stem 58 below the necked down portion 57 causes the valve to be thrust upwardly against the bias of the spring 74 to the extent permitted by the lift stop and ejection of fuel under high pressure through the orifices 42 takes place. Upon completion of the injection of the measured charge of fuel, the fluid pressure at the inlet 36 and in the valve chamber 48 is reduced so that the spring 74 may return the valve to its closed position.

By reason of the provision of a three-part valve body arrangement, the nozzle tip, the valve guide, and the nozzle holder may be independently manufactured at lower cost. The nozzle is simple to assemble and adjust and permits the use of materials having different mechanical properties for the different parts of the nozzle to provide a long service life for the different portions of the nozzle. Moreover, in the event of wear to the tip, the valve, or the valve guide, requiring replacement, these parts may be removed and replaced without discarding the the entire assembly.

As will be apparent to persons skilled in the art, various modifications adaptations and variations of the foregoing specific disclosure can be made without departing from the teachings of the present invention.

I claim:

1. An inwardly opening pressure actuated fuel injection nozzle, a valve body comprising a nozzle holder, a cylindrical valve guide and a nozzle tip providing a valve chamber, a unitary valve plunger of smaller cross-section than said chamber extending into said chamber and mounted by said valve guide for reciprocation toward and away from a valve seat formed at the discharge end of the nozzle tip, said nozzle tip having a cylindrical flange engageable with the end of said valve guide, a biasing spring biasing said valve plunger toward said valve seat, a retaining nut telescoped over the cylindrical flange of said nozzle tip and over said valve guide and threadably engaging said nozzle holder for coupling said valve guide and said nozzle tip to said holder, said retaining nut receiving both the outer periphery of the cylindrical flange of said nozzle tip and said valve guide with a close slidng fit to automatically align the axes of the valve guide and the nozzle tip during the assembly of the nozzle, communicating passages in the walls of said nozzle holder, valve guide and nozzle tip to deliver incoming fuel to the valve chamber, and locating pin means spanning the sealing surfaces between said nozzle holder and valve guide and between said valve guide and nozzle tip to angularly position and maintain said passages in communicating relationship, said locating pin means comprising a pair of pins respectively located in the ends of a single stepped bore in the side wall of said valve guide whereby the smaller of said pins may be depressed into said bore to press the larger of said pins out of said bore.

2. An inwardly opening pressure actuated fuel injection nozzle, a valve body comprising a nozzle holder, a cylindrical valve guide and a nozzle tip providing a valve chamber, a unitary valve plunger of smaller cross-section than said chamber extending into said chamber and mounted by said valve guide for reciprocation toward and away from a valve seat formed at the discharge end of the nozzle tip, said nozzle tip having a cylindrical flange engageable with the end of said valve guide, a biasing spring biasing said valve plunger toward said valve seat, a retaining nut telescoped over the cylindrical flange of said nozzle tip and over said valve guide and threadably engaging said nozzle holder for coupling said valve guide and said nozzle tip to said holder, said retaining nut receiving both the outer periphery of the cylindrical flange of said nozzle tip and said valve guide with a close sliding fit to automatically align the axes of the valve guide and the nozzle tip during the assembly of the nozzle, a cylindrical gland nut surrounding the nozzle holder, said gland nut having external threads engageable with mating threads in the nozzle bore of an engine for mounting the nozzle in the engine, and a keeper ring engageable with a shoulder at the outer end of the gland nut whereby the unscrewing of the gland nut creates an axial extracting force for the removal of the nozzle from the engine.

* * * * *